US010232496B2

(12) United States Patent
Chang

(10) Patent No.: US 10,232,496 B2
(45) Date of Patent: Mar. 19, 2019

(54) LOCKING STRUCTURE FOR HAND TOOL

(71) Applicant: Ting-Kai Chang, Taichung (TW)

(72) Inventor: Ting-Kai Chang, Taichung (TW)

( * ) Notice: Subject to any disclaimer, the term of this patent is extended or adjusted under 35 U.S.C. 154(b) by 331 days.

(21) Appl. No.: 15/298,231

(22) Filed: Oct. 20, 2016

(65) Prior Publication Data

US 2018/0111253 A1 Apr. 26, 2018

(51) Int. Cl.
*B25B 23/00* (2006.01)
*B25B 13/46* (2006.01)

(52) U.S. Cl.
CPC ..... *B25B 23/0035* (2013.01); *B25B 13/461* (2013.01); *B25B 13/463* (2013.01)

(58) Field of Classification Search
CPC .. B25B 23/0035; B25B 13/461; B25B 13/463
See application file for complete search history.

(56) References Cited

U.S. PATENT DOCUMENTS 4,592,255 A * 6/1986 Mayer ..... B25B 13/463 81/62
4,703,676 A * 11/1987 Mayer ..... B25B 13/463 81/60
6,752,046 B1 * 6/2004 Lee ..... B25B 13/461 81/177.85
6,948,406 B1 * 9/2005 Li ..... B25B 13/461 81/60
9,205,538 B2 * 12/2015 Yang ..... B25B 13/463
9,849,569 B2 * 12/2017 Su ..... B25B 13/463
9,931,737 B2 * 4/2018 Kao ..... B25B 13/463
2016/0214241 A1 * 7/2016 Kao ..... B25B 13/463

* cited by examiner

*Primary Examiner* — Bryan R Muller

(57) ABSTRACT

A locking structure for a hand tool contains: a body including a driving head. The driving head has an accommodation cavity and a notch, and the accommodation cavity has a trench and an indentation. A fixer is accommodated in the indentation and has a limiting groove, a cutout, a post, and a recess. A second actuation member is housed in the limiting groove and has a locking portion, a locating portion, a protrusion, a control portion, a first aperture, and a second aperture. A release button is accommodated in the notch and has a tough for housing a retaining element. Furthermore, a first stop ring is located under the second actuation member and is configured to separate the second actuation member from the first actuation member, a ratchet rotation block is fixed under the first stop ring, and a second stop ring is mounted under the ratchet rotation block.

3 Claims, 13 Drawing Sheets

LOCKING STRUCTURE FOR HAND TOOL

FIELD OF THE INVENTION

The present invention relates to a locking structure for a hand tool which locks and unlocks the hand tool quickly by way of an actuation member and a release button.

BACKGROUND OF THE INVENTION

A hand tool (such as a socket wrench) contains a locking ball housed in an operation hole thereof so as to lock a fitting tool (such as a socket).

However, the fitting tool cannot be locked by the locking ball securely and cannot be removed from the locking ball quickly.

The present invention has arisen to mitigate and/or obviate the afore-described disadvantages.

SUMMARY OF THE INVENTION

The primary objective of the present invention is to provide a locking structure for a hand tool which locks and unlocks the hand tool quickly by way of an actuation member and a release button.

To obtain above-mentioned objective, a locking structure for a hand tool provided by the present invention contains: a body including a driving head.

The driving head has an accommodation cavity, the accommodation cavity has a trench formed on a rear end of the accommodation cavity and configured to house a first actuation member, and the accommodation cavity also has an indentation arranged above the trench, the driving head further has a notch defined on an outer wall of the driving head and communicating with the indentation via an elongated orifice.

A fixer is accommodated in the indentation and has a limiting groove arranged on a bottom of the fixer, a cutout formed on a first side of the limiting groove, a post fixed on a second side of the limiting groove, and a recess formed on a rear end of the limiting groove.

A second actuation member is housed in the limiting groove of the fixer, and the second actuation member has a locking portion arranged on a first side of the second actuation member, a locating portion adjacent to the locking portion and retained in the cutout of the fixer, a protrusion extending outwardly from one end of the second actuation member and fitting with a resilient element, a control portion formed on a second side of the second actuation member opposite to the locating portion, a first aperture defined on a central position of the second actuation member, and a second aperture formed adjacent to the control portion.

A release button is accommodated in the notch of the driving head, and the release button has a tough defined therein and configured to house a retaining element.

The post of the fixer is accommodated in the first aperture of the second actuation member.

The control portion of the second actuation member extends out of the notch via the elongated orifice and is housed in the trough of the release button, and the retaining element of the release button is retained in the second aperture of the second actuation member.

Furthermore, a first stop ring is located under the second actuation member, a ratchet rotation block is fixed under the first stop ring, and a second stop ring is mounted under the ratchet rotation block, wherein the first stop ring is configured to separate the second actuation member from the first actuation member.

When a fitting tool is fitted into an operation hole of the ratchet rotation block so as to retain with the locking portion of the second actuation member, the locking portion retracts inwardly via the post, and the protrusion of the second actuation member is retained in the recess of the fixer, hence the resilient element contacts with the indentation, and the fitting tool continuously inserts into the operation hole until a trough of the fitting tool flushes with the second actuation member, such that the locking portion is pushed by the resilient element to move into the trough, thus locking the fitting tool.

When locking portion locks the fitting tool and the release button is pushed to drive the control portion to move forward, the locking portion retracts backward to remove from the trough of the fitting tool, thus unlocking the fitting tool.

DETAILED DESCRIPTION OF THE PREFERRED EMBODIMENTS

Figure 1:
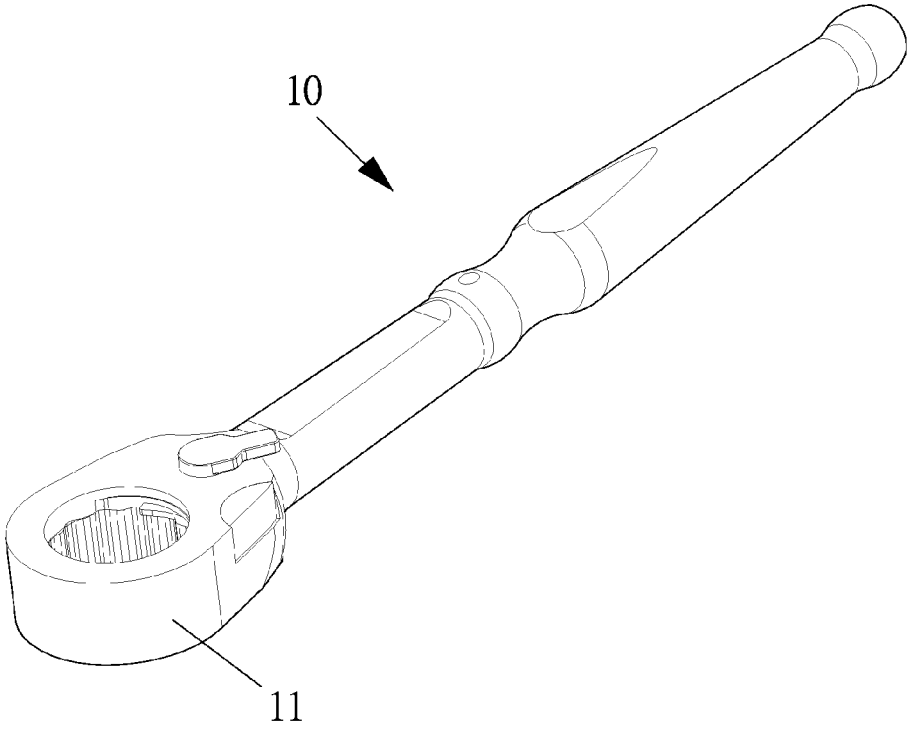
FIG. 1 is a perspective view showing the assembly of a locking structure for a hand tool according to a preferred embodiment of the present invention.
Figure 3:
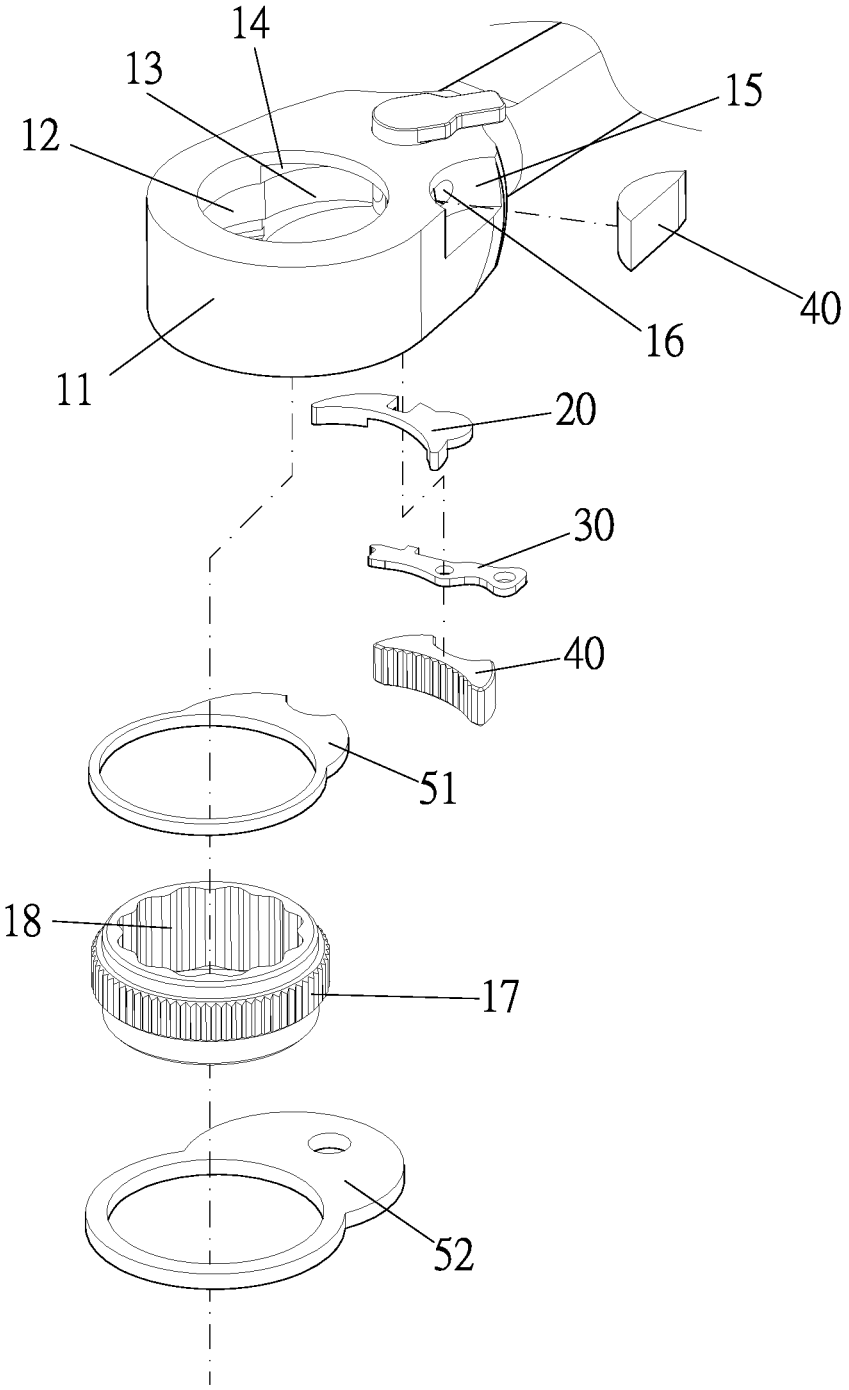
FIG. 3 is a perspective view showing the exploded components of the locking structure for the hand tool according to the preferred embodiment of the present invention.
Figure 4:
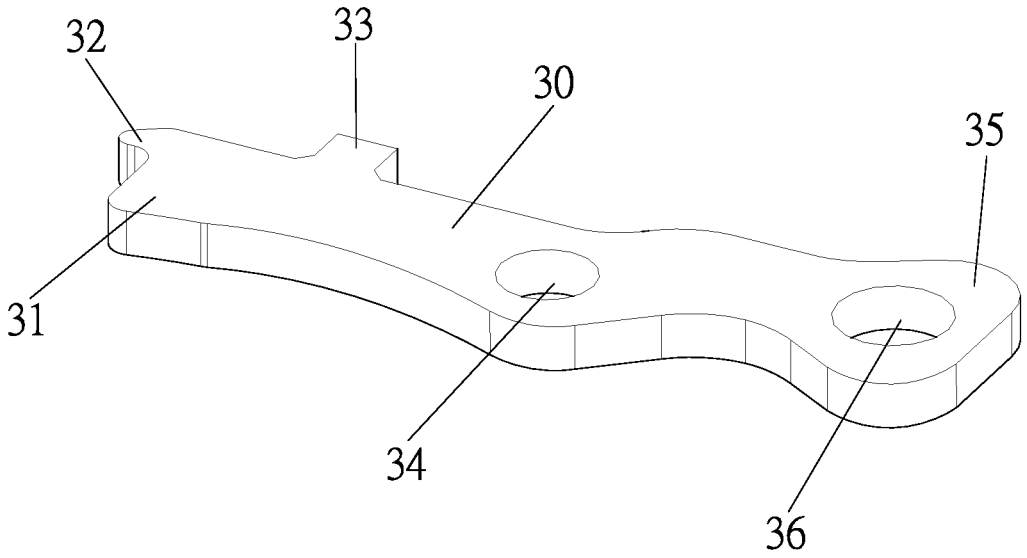
FIG. 4 is a perspective view showing the assembly of a part of the locking structure for the hand tool according to the preferred embodiment of the present invention.
Figure 5:
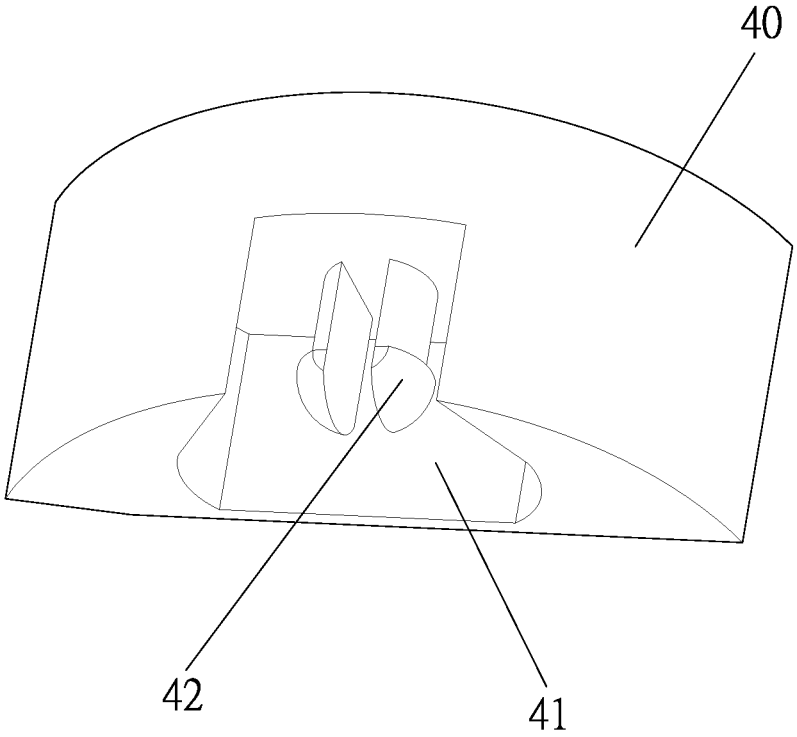
FIG. 5 is another perspective view showing the assembly of a part of the locking structure for the hand tool according to the preferred embodiment of the present invention.
Figure 6:
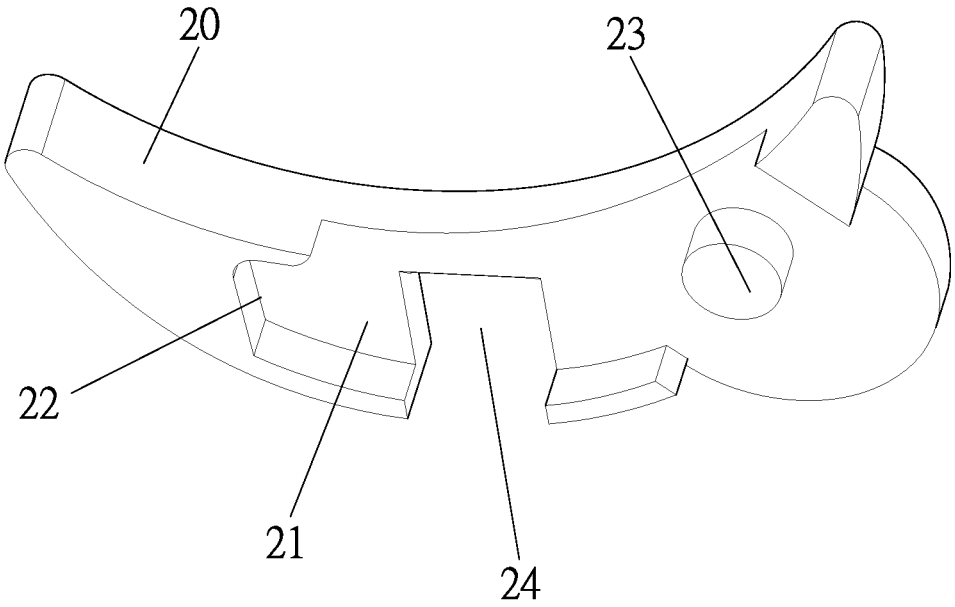
FIG. 6 is also another perspective view showing the assembly of a part of the locking structure for the hand tool according to the preferred embodiment of the present invention.
Figure 7:
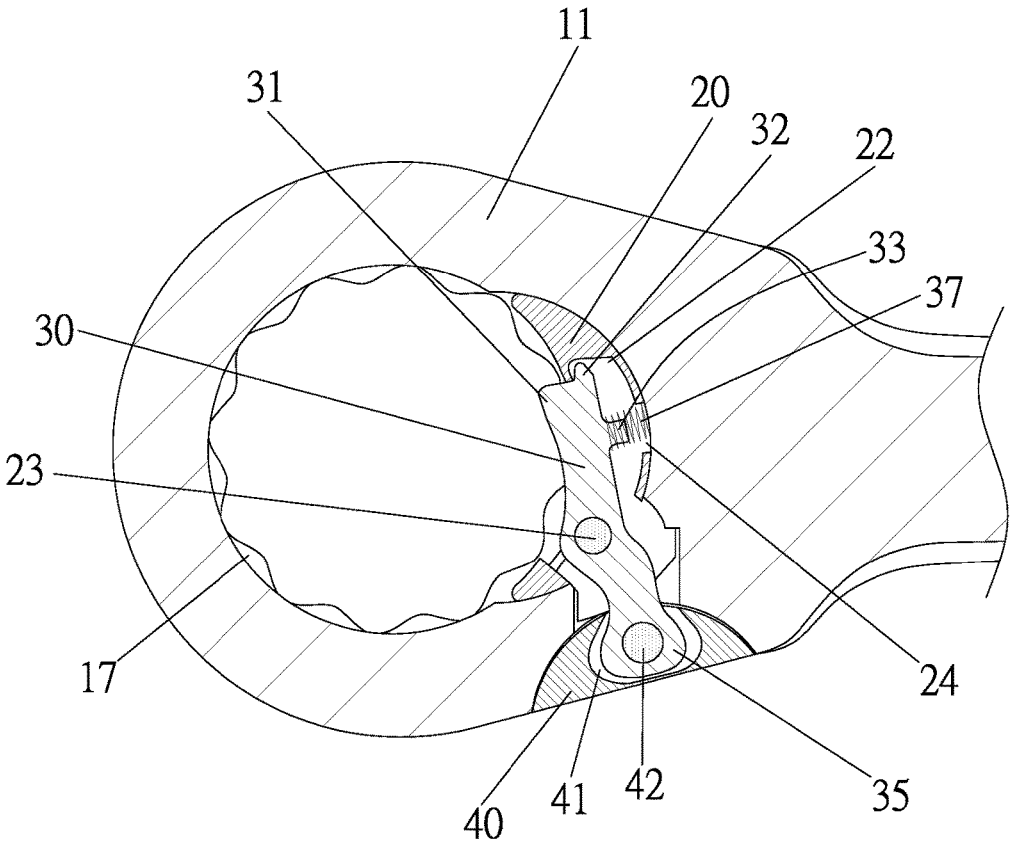
FIGS. 7-13 are a cross sectional view showing the operation of the locking structure for the hand tool according to the preferred embodiment of the present invention.

With reference to FIGS. 1 and 3-7, a locking structure for a hand tool according to a preferred embodiment of the present invention comprises: a body 10 including a driving head 11, and the driving head 11 has an accommodation cavity 12 defined therein. The accommodation cavity 12 has a trench 13 formed on a rear end thereof and configured to house a first actuation member 50, and the accommodation cavity 12 has an indentation 14 arranged above the trench 13. The driving head 11 further has a notch 15 defined on an outer wall thereof and communicating with the indentation 14 via an elongated orifice 16.

A fixer 20 is accommodated in the indentation 14 and has a limiting groove 21 arranged on a bottom of the fixer 20, a cutout 22 formed on a first side of the limiting groove 21, a post 23 fixed on a second side of the limiting groove 21, and a recess 24 formed on a rear end of the limiting groove 21.

A second actuation member 30 is housed in the limiting groove 21 of the fixer 20, and the second actuation member 30 has a locking portion 31 arranged on a first side of the second actuation member 30, a locating portion 32 adjacent to the locking portion 31 and retained in the cutout 22 of the fixer 20, a protrusion 33 extending outwardly from one end of the second actuation member 30 and fitting with a resilient element 37, a control portion 35 formed on a second side of the second actuation member 30 opposite to the locating portion 32, a first aperture 34 defined on a central position of the second actuation member 30, and a second aperture 36 formed adjacent to the control portion 35.

A release button 40 is accommodated in the notch 15 of the driving head 11, and the release button 40 has a trough 41 defined therein and configured to house a retaining element 42.

The post 23 of the fixer 20 is accommodated in the first aperture 34 of the second actuation member 30, the control portion 35 of the second actuation member 30 extends out of the notch 15 via the elongated orifice 16 and is housed in the trough 41 of the release button 40, and the retaining element 42 of the release button 40 is retained in the second aperture 36 of the second actuation member 30.

Furthermore, a first stop ring 51 is located under the second actuation member 30, a ratchet rotation block 17 is fixed under the first stop ring 51, and a second stop ring 52 is mounted under the ratchet rotation block 17, wherein the first stop ring 51 is configured to separate the second actuation member 30 from the first actuation member 50.

Figure 2:
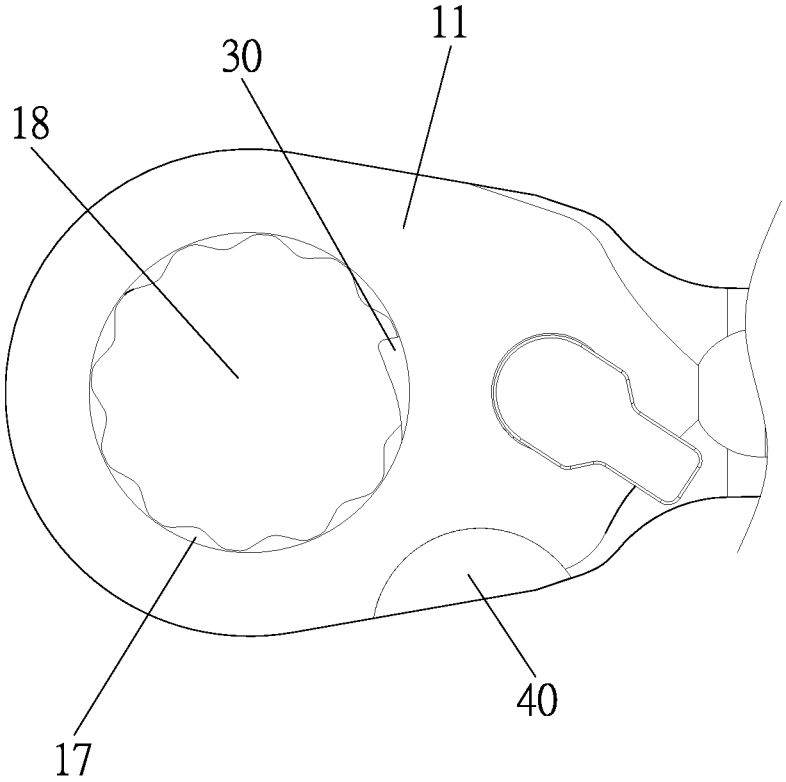
FIG. 2 is a top plane view showing the assembly of the locking structure for the hand tool according to the preferred embodiment of the present invention.
Figure 8:
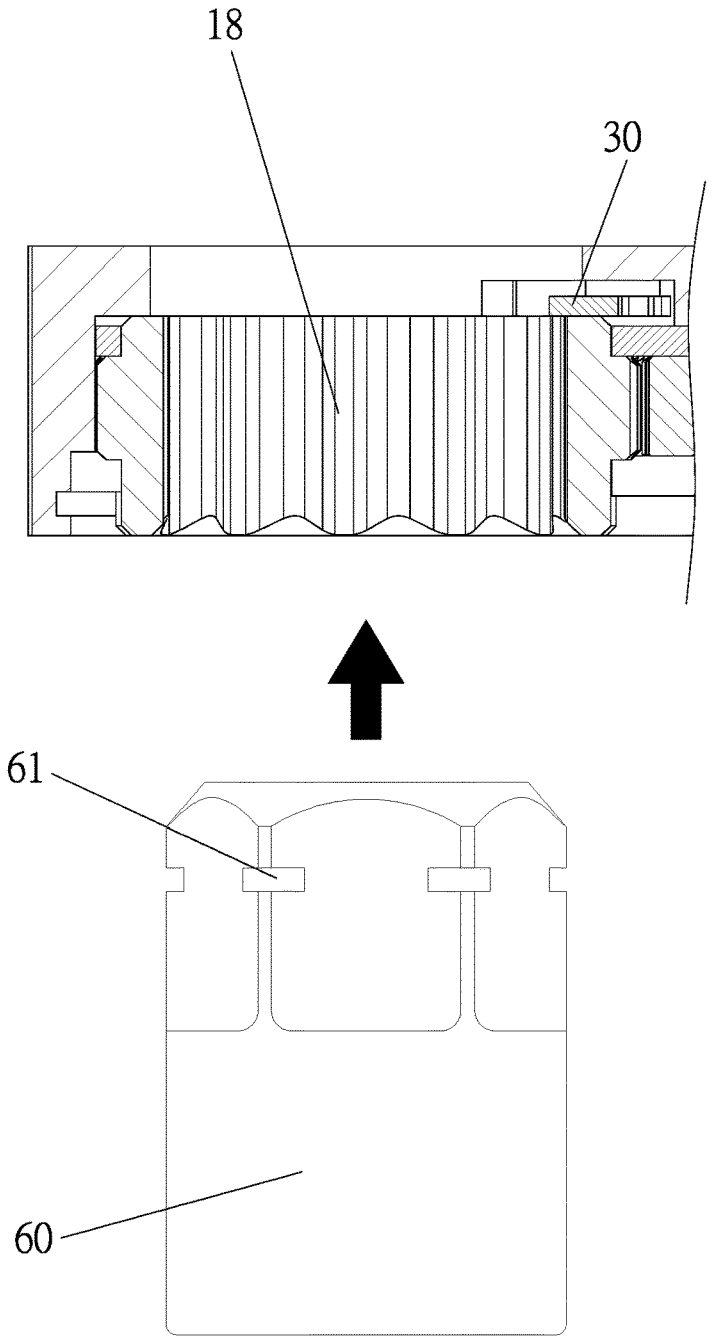
Figure 9:
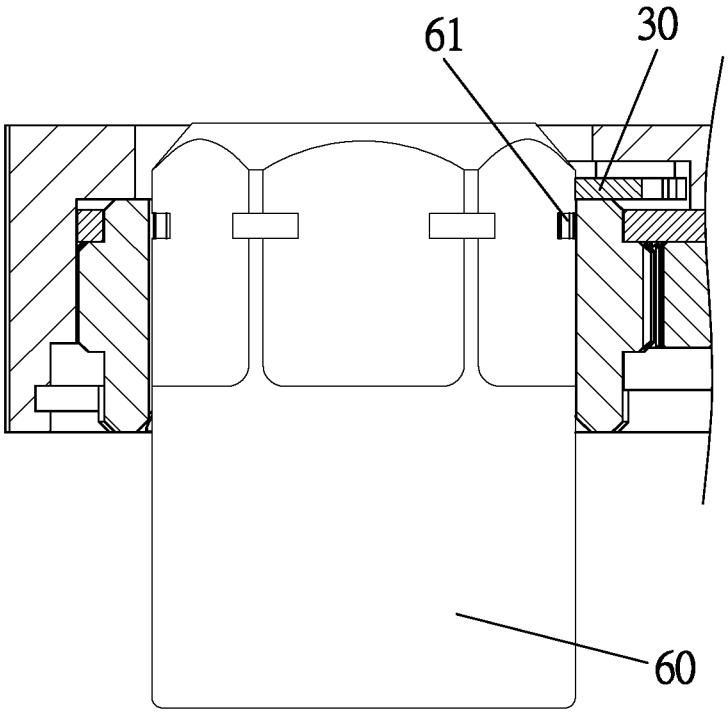
Figure 10:
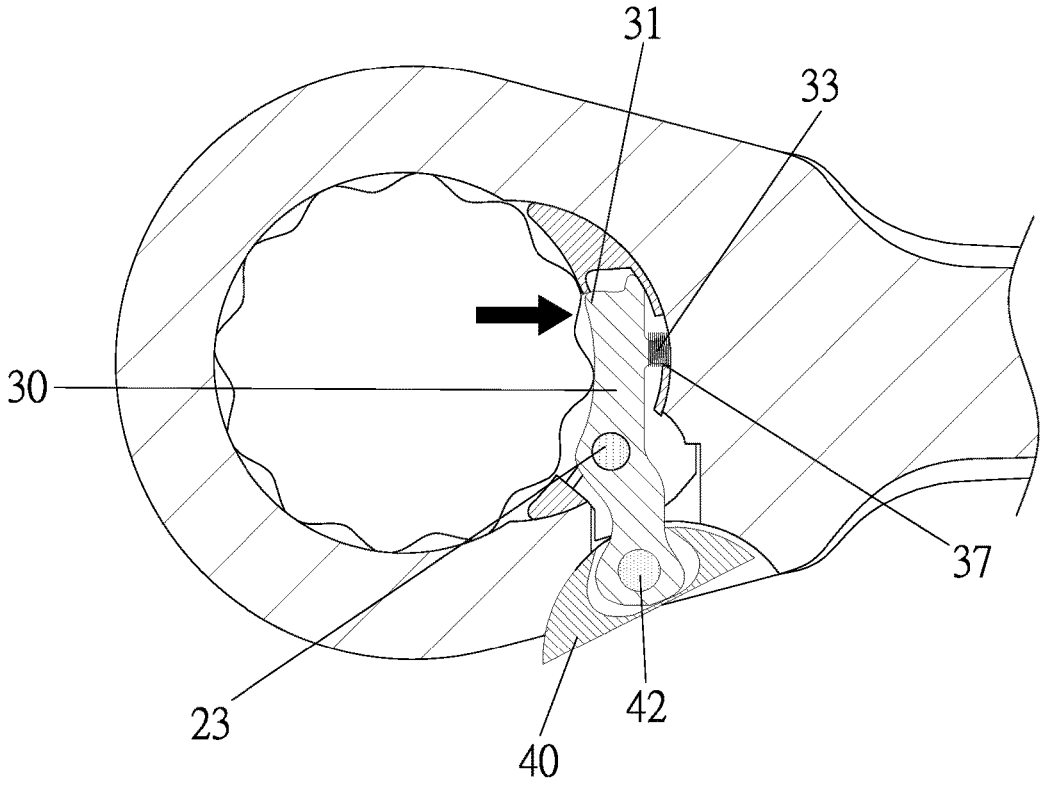
Figure 11:
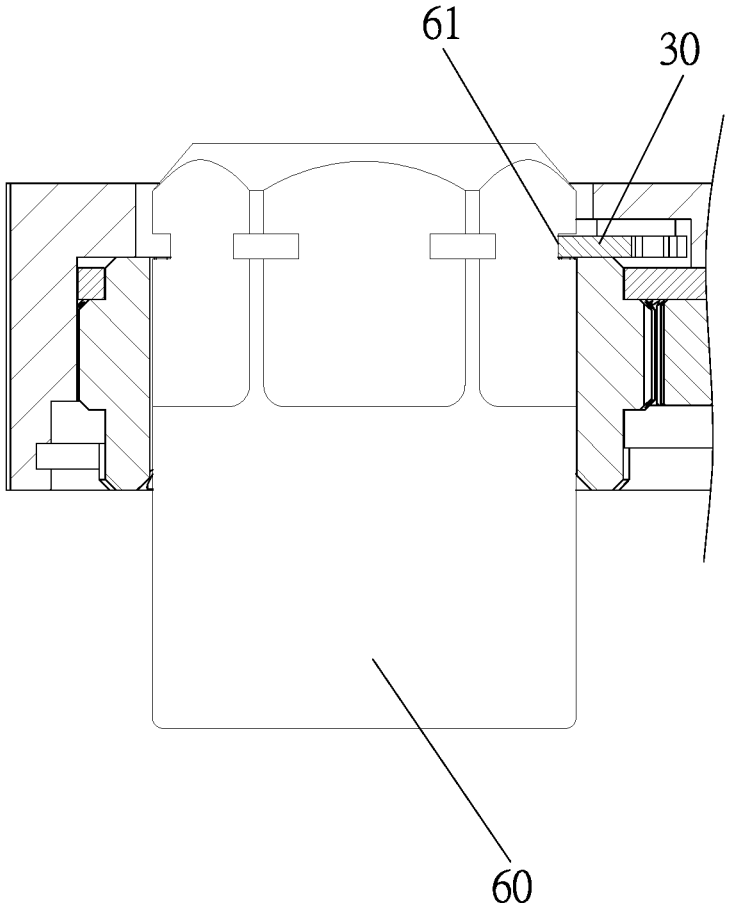
Figure 12:
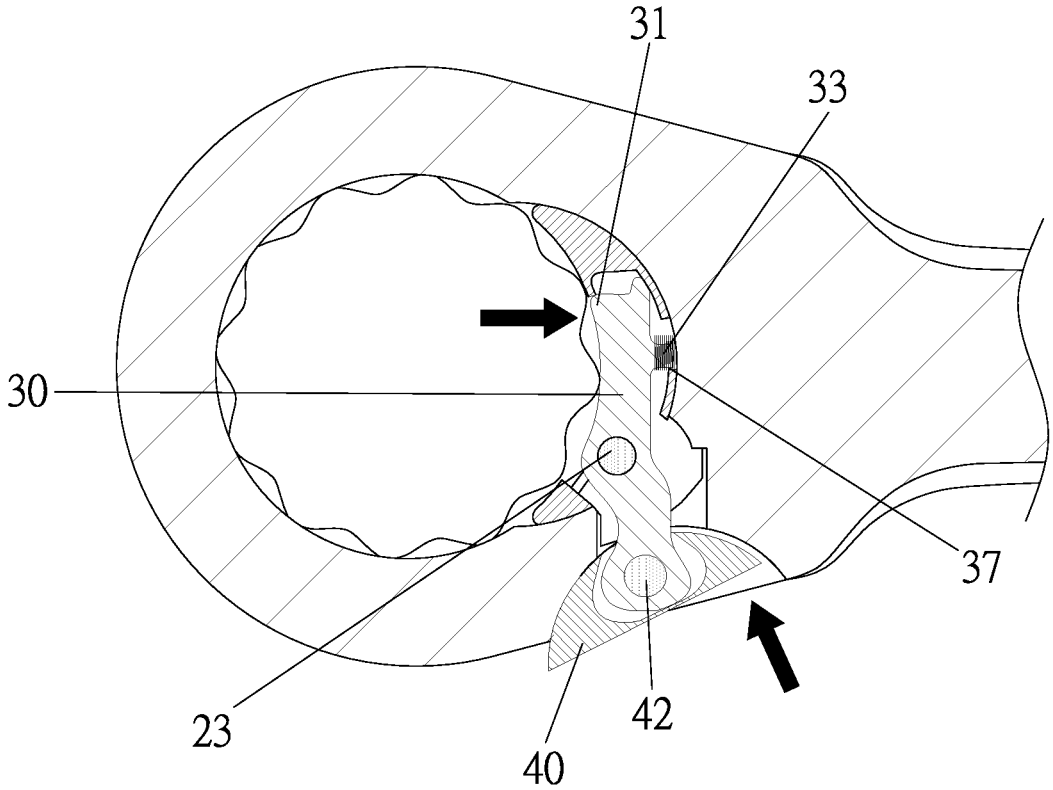
Figure 13:
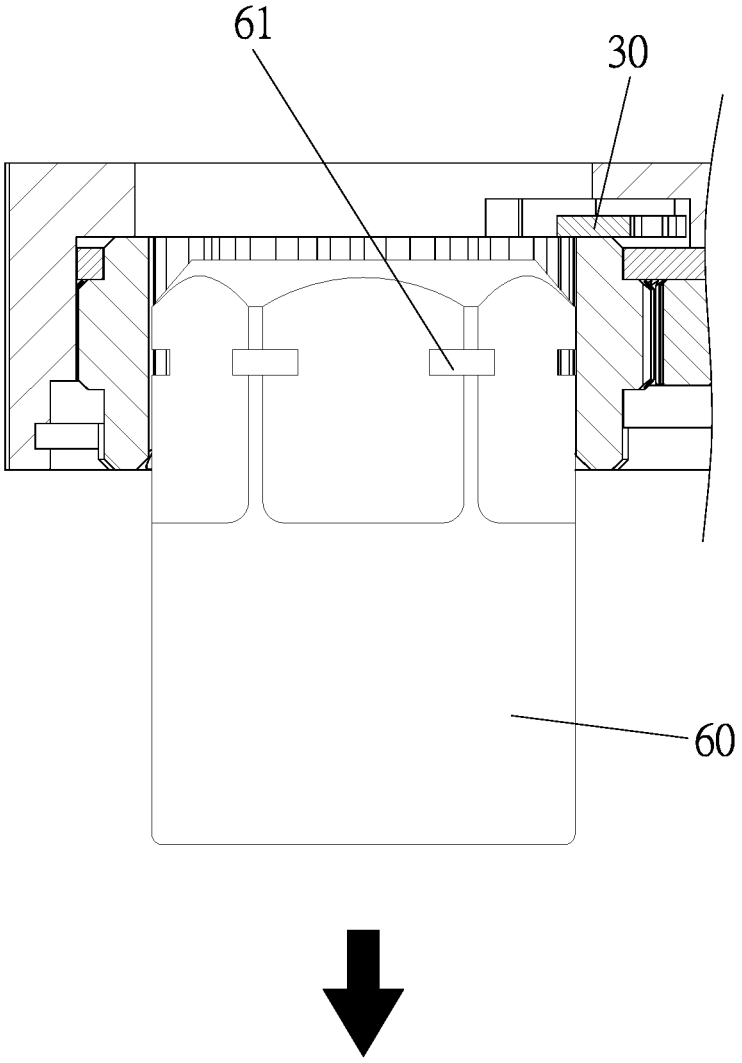

Referring to FIGS. 2 and 7-13, when a fitting tool 60 is fitted into an operation hole 18 of the ratchet rotation block 17, the locking portion 31 of the second actuation member 30 retracts inwardly about the post 23, and the protrusion 33 of the second actuation member is retained in the recess 24 of the fixer 20, the resilient element 37 contacts a wall of the indentation 14, and as the fitting tool 60 is further inserted into the operation hole 18 until a trough 61 of the fitting tool 60 aligns with the second actuation member 30, such that the locking portion 31 is pushed by the resilient element 37 to move into the trough 61, thus locking the fitting tool 60 into the operation hole.

Thereafter, the release button 40 is pushed to drive the control portion 35 to move forward, and the locking portion 31 retracts backward to remove from the trough 61 of the fitting tool 60, thus unlocking the fitting tool 60.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A locking structure for a hand tool comprising: a body including a driving head;

the driving head having an accommodation cavity, the accommodation cavity having a trench formed on a rear end of the accommodation cavity and configured to house a first actuation member, and the accommodation cavity also having an indentation arranged above the trench, the driving head further having a notch defined on an outer wall of the driving head and communicating with the indentation via an elongated orifice;

a fixer accommodated in the indentation and having a limiting groove arranged on a bottom of the fixer, a cutout formed on a first side of the limiting groove, a post fixed on a second side of the limiting groove, and a recess formed on a rear end of the limiting groove;

a second actuation member housed in the limiting groove of the fixer, and the second actuation member having a locking portion arranged on a first side of the second actuation member, a locating portion adjacent to the locking portion and retained in the cutout of the fixer, a protrusion extending outwardly from one end of the second actuation member and fitting with a resilient element, a control portion formed on a second side of the second actuation member opposite to the locating portion, a first aperture defined on a central position of the second actuation member, and a second aperture formed adjacent to the control portion;

a release button accommodated in the notch of the driving head, and the release button having a trough defined therein and configured to house a retaining element;

wherein the post of the fixer is accommodated in the first aperture of the second actuation member;

wherein the control portion of the second actuation member extends out of the notch via the elongated orifice and is housed in the trough of the release button, and the retaining element of the release button is retained in the second aperture of the second actuation member;

wherein a first stop ring is located under the second actuation member, a ratchet rotation block is fixed under the first stop ring, and a second stop ring is mounted under the ratchet rotation block, wherein the first stop ring is configured to separate the second actuation member from the first actuation member.

2. The locking structure as claimed in claim 1, wherein when a fitting tool is fitted into an operation hole of the ratchet rotation block, the locking portion of the second actuation member retracts inwardly about the post, and the protrusion of the second actuation member is retained in the recess of the fixer, the resilient element contacts a wall of the indentation, and as the fitting tool is further inserted into the operation hole until a trough of the fitting tool aligns with the second actuation member, such that the locking portion is pushed by the resilient element to move into the trough, thus locking the fitting tool into the operation hole.

3. The locking structure as claimed in claim 1, wherein when locking portion engages the fitting tool and the release button is pushed to drive the control portion to move forward, the locking portion retracts backward to remove from the trough of the fitting tool, thus unlocking the fitting tool.

* * * * *